United States Patent [19]

Seleski et al.

[11] 4,077,579

[45] Mar. 7, 1978

[54] EDGE ALIGNMENT APPARATUS

[75] Inventors: Richard C. Seleski, Glen Cove; Glenn E. Peterson, Carle Place; William J. Schoenlein, Levittown, all of N.Y.

[73] Assignee: Columbia Ribbon & Carbon Mfg. Co., Inc., Glen Cove, N.Y.

[21] Appl. No.: 676,300

[22] Filed: Apr. 12, 1976

[51] Int. Cl.[2] ..... B65H 25/26

[52] U.S. Cl. ..... 242/57.1; 226/20; 250/548

[58] Field of Search ..... 242/57.1; 250/571, 548; 226/3, 15, 19, 20

[56] References Cited

U.S. PATENT DOCUMENTS

| | | | |
|---|---|---|---|
| 1,186,906 | 6/1916 | Hopkins | 242/57.1 |
| 1,972,075 | 9/1934 | Clark | 242/57.1 |
| 2,078,669 | 4/1937 | King | 226/20 X |
| 2,786,675 | 3/1957 | Montefalco | 242/57.1 |
| 3,132,253 | 5/1964 | Sorsen | 242/57.1 X |
| 3,570,735 | 3/1971 | Kurz | 242/57.1 |

*Primary Examiner*—Edward J. McCarthy
*Attorney, Agent, or Firm*—Thomas L. Tully

[57] ABSTRACT

Apparatus for checking the edge alignment of a moving web and for making lateral adjustments in the position of the moving web to correct for deviations.

8 Claims, 5 Drawing Figures

EDGE ALIGNMENT APPARATUS

The present invention is concerned with the problem of correcting the alignment of a web while the web is being transported, such as from a supply roll to a take-up roll, without varying the speed of the web and without encountering excessive corrections which disrupt the alignment of the web in a direction opposite to the original deviation.

There are a great many operations in which a web of material such as paper, plastic film, cloth or other fabric is transported from a supply roll to a take-up roll. Most such operations involve the conversion of a web of fabric material of uniform width into a more functional element such as by means of the application of a print or coating to the fabric. Examples of such operations involve the application of a pressure-transferable coating to a paper or plastic film foundation to produce pressure-sensitive transfer elements such as carbon papers, and the inpregnation of fabric webs with liquid inks to produce chain printer ribbons or computer ribbons. In other operations the web of fabric material has its original dimensions changed during the operation, such as in the case of oriented, stretched plastic films and fabric webs which are cut into more narrow widths.

In all such cases there is a need to align the web during transport so that the web has perfect edge alignment as it is collected on the take-up roll. Such alignment improves the appearance of the rolled material, prevents damage to the edge of the web during winding, packaging and shipping and insures the uniformity of the web during subsequent use.

Many methods and devices are known for the alignment of webs of fabric material. However such known methods and devices have one or more disadvantages which make them unsuitable for operations in which the web of material must be transported at a relatively high uniform speed, reductions in such speed affecting the uniformity of the printing, coating, inking, or other treatment being given to the web. Thus some known alignment devices require that the web is moved slowly, or its speed is reduced during adjustment, because the response of the devices to the correction signals is slow and/or because the devices tend to overcorrect the alignment. These disadvantages are minimized as the speed of the web is reduced. Some known alignment devices also subject the web to continuous adjustment motion with no means for reducing the sensitivity of the device to permit minor variations in edge alignment to pass. Such continuous adjustment frequently produces overcorrections and increased wear on the apparatus.

It is the principal object of the present invention to provide a novel improved apparatus for aligning a continuous web of fabric, while such web is being transported at a relatively uniform speed, adjustments in the alignment being made smoothly and relatively instantaneously.

It is another object of this invention to provide a novel improved alignment apparatus for making corrections in the edge alignment of a moving web of fabric material in such a manner that wrinkling of the web and overcorrections in alignment are avoided.

It is yet another object of the present invention to provide an edge alignment apparatus for continuous moving webs of fabric material wherein the desired degree of sensitivity can be preset in the apparatus to permit minor variations in the edge alignment of the web to cause no response from the alignment means.

It is still another object of the present invention to provide an edge alignment apparatus for continuous moving webs of fabric material which apparatus contains photoelectric means for causing stoppage of the movement of the web in the event of an abrupt complete change in the photoelectric beam.

These and other objects and advantages of the present invention will be apparent to those skilled in the art in the light of the present disclosure including the drawings in which.

The objects and advantages of the present invention are accomplished by means of a novel alignment apparatus in which a continuous web or ribbon is transported at a uniform speed from a supply roll through a work station and onto a take-up roll and is maintained in perfect edge alignment in such a manner that the speed of the web is not changed due to the alignment adjustment, wrinkling of the web is avoided and overcorrections in alignment are not encountered.

Figure 1:
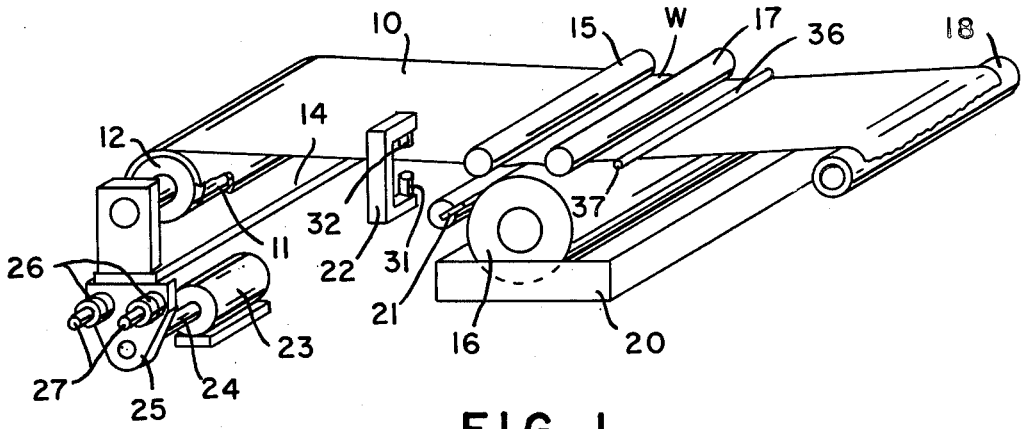
FIG. 1 is a perspective view of an apparatus according to one embodiment of the present invention illustrating a moving fabric web or ribbon being aligned during an inking operation.

Referring to FIG. 1 of the drawing which illustrates the use of the present edge alignment apparatus used on a printing ribbon inking device, a fabric web such as a woven fabric ribbon 10 wound on a core 11 is attached to a pair of opposed spindles 12 and 13 (shown more clearly in FIG. 3) mounted on a laterally-adjustable carriage 14. Spindle 12 is provided with a tension brake to maintain the expended web taut while spindle 13 is spring-loaded and adjustable to accommodate cores 11 of different lengths in relatively tight frictional engagement.

Figure 2:
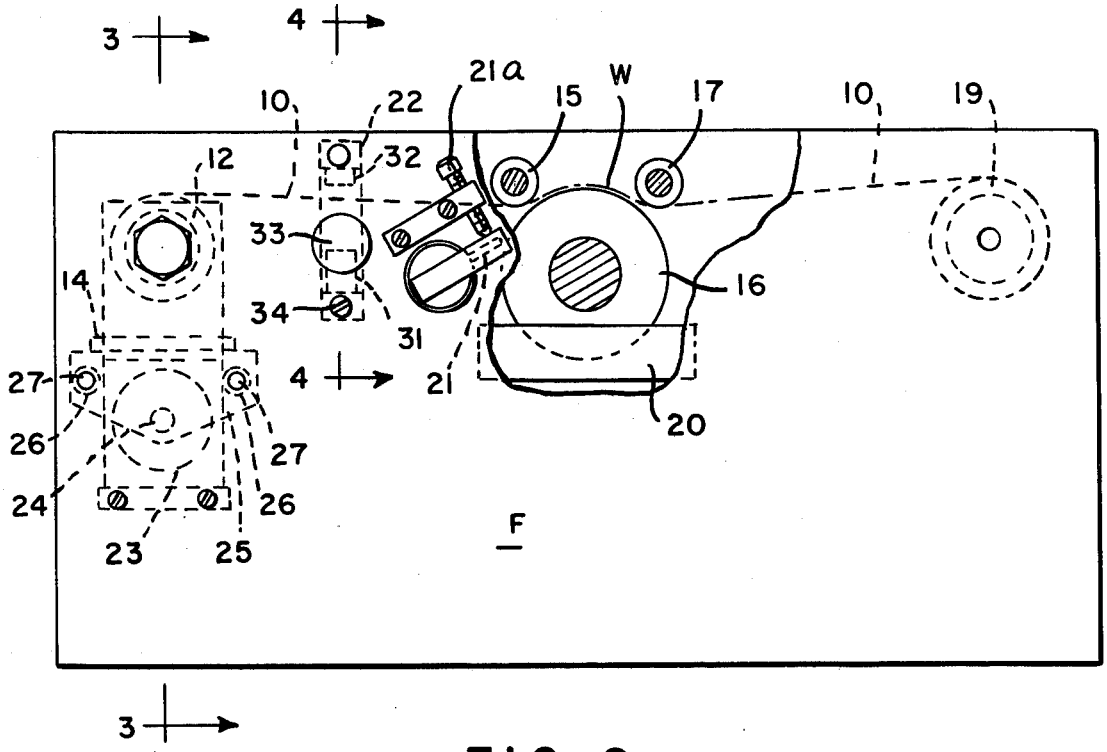
FIG. 2 is a cross-sectional side view of a ribbon inking machine incorporating an edge alignment means according to the present invention.

The expended web or ribbon 10 passes beneath a first idler roll 15, wraps up and over a gravure inking roller 16 and then passed down under a second idler roll 17 and is collected on an empty core 18 mounted on a pair of spindles 19 (FIG. 2), one of which is spring-loaded and adjustable for frictional engagement with cores of various lengths and the other of which is motor-driven to pull the web or ribbon 10 through the apparatus.

The amount of ink transferred from ink pan 20 to the web or ribbon 10 can be varied by the use of gravure ink rolls 16 of different capacities, or by reducing the speed at which the ink roll rotates or increasing the speed at which the web or ribbon 10 is drawn through the apparatus whereby the surface speed of ink roll 16 is slower than the speed of web or ribbon 10 so that the ink roll places a drag on the web or ribbon to produce a wiping action of the ribbon as it wraps over the ink roll 16.

The apparatus illustrated by the drawings is provided with an edge guide system which enables a used web or ribbon to be placed in perfect edge alignment prior to the re-inking operation. Generally a used ribbon will be out of edge alignment and will develop wrinkles and areas of unequal stress if it is passed through a re-inking apparatus in this condition.

Figure 3:
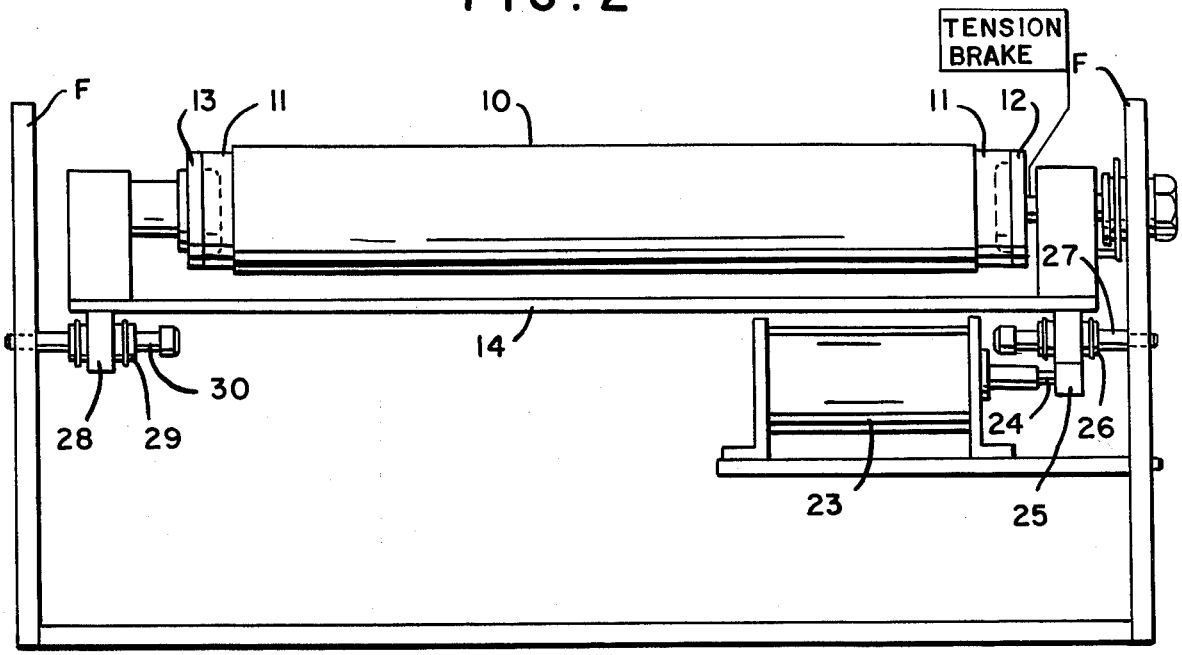
FIG. 3 is a cross-sectional end view of the apparatus of FIG. 2 taken along the line 3—3 and illustrating the ribbon core-supporting spindle carriage, its support and the activating solenoid.

The edge alignment system of the present apparatus as shown in FIGS. 1 to 4 of the drawing, comprises a photoelectric edge sensor 22 which is associated with a bi-directional D.C. solenoid 23 such as a Ledex LB-22 dual coil solenoid having a bi-directional core or piston 24 connected to the adjustable carriage 14 supporting the ribbon core 11 carrying the wound ribbon 10. The application of current to either of the coils of the solenoid causes the piston 24 to move in either direction. As shown by FIG. 3, the solenoid 23 is fixed to the frame F of the apparatus and the piston 24, which has the ability to travel ±0.25 inch, is connected to sliding mount 25 having twin sleeves 26 which movably support the carriage 14 on twin support shafts 27 fixed to the frame. The other end of the carriage 14 also is provided with a sliding mount 28 containing twin sleeves 29 which movably support the carriage 14 on twin support shafts 30. As can be seen, movement of piston 24 in or out will cause the attached carriage 14 to move in a corresponding direction.

Figure 4:
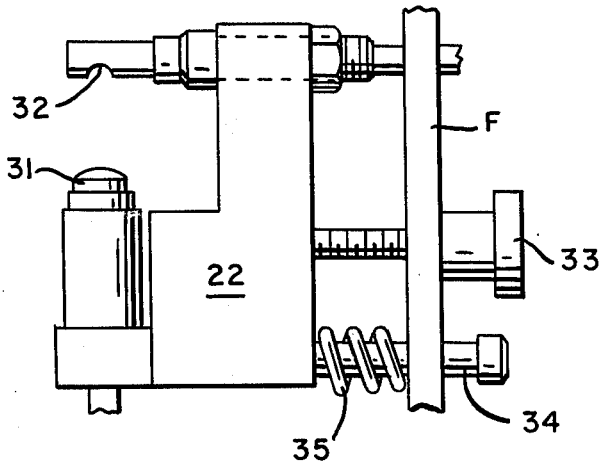
FIG. 4 is a cross-sectional end view of a portion of the apparatus of FIG. 2 taken along the line 4—4 and illustrating the photocell device of the edge alignment system.

The photoelectric edge sensor 22, more clearly illustrated by FIG. 4, comprises a light source 31 and a photocell 32 spaced directly thereover to provide a passage adapted to admit the edge of the web or ribbon 10. The sensor 22 is attached to the frame F of the apparatus by means of knob bolt 33 and shoulder bolt 34 and spring 35, and its position is adjustable to accommodate webs or ribbons of different widths.

Figure 5:
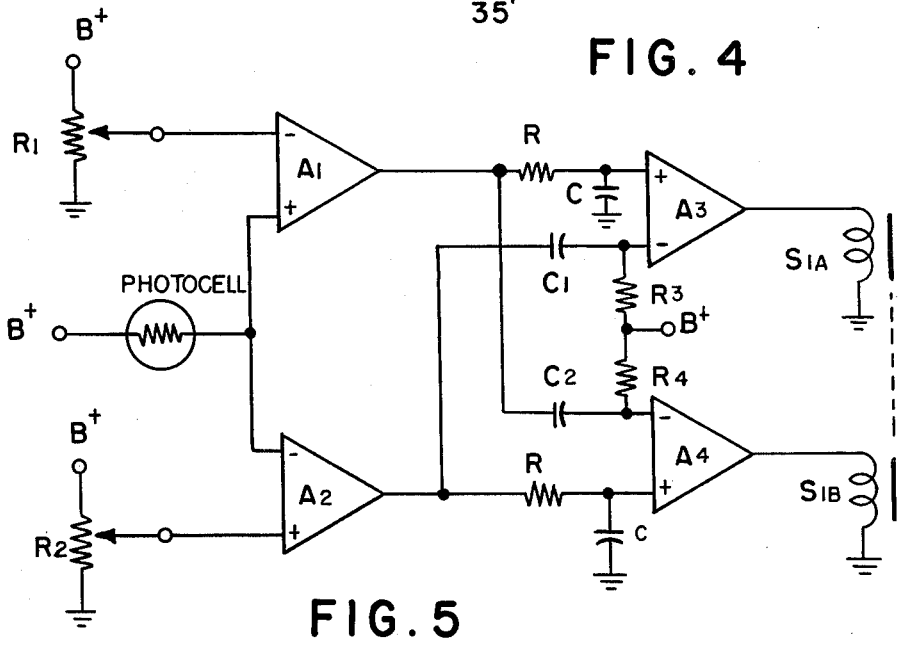
FIG. 5 is a schematic view of the electric circuit for the edge alignment system of the present apparatus.

Referring to FIG. 5 of the drawing, the photocell 32 of sensor 22 is connected to operational amplifier comparators A1 and A2, to the non-inverting input of A1 and to the inverting input of A2. A suitable component for this purpose is a Motorola MC-1458 dual operational amplifier. The threshold points of A1 and A2 are independently adjustable by potentiometers R1 and R2. R1 and R2 are adjusted to produce a narrow "dead" band, a level of illumination on the photocell which produces no output from either A1 or A2. This "dead" band corresponds to the level of illumination on the photocell when the edge of a web or ribbon covers about one-half of the light beam passing between light source 31 and photocell 32. The width of the "dead" band can be adjusted to any desired degree by spacing the threshold points of A1 and A2 to provide an apparatus having any desired sensitivity.

When photocell illumination increases, i.e., when the edge of the web or ribbon moves outwardly from the center of the light beams, A1 produces a positive output. Conversely, when photocell illumination decreases, i.e., when the edge of the web or ribbon moves inwardly from the center of the light beam to block or shade more than one-half thereof, comparator A2 produces a positive output.

The pulse outputs of A1 and A2 are slope-modified by R-C integrating networks and coupled to output amplifiers A3 and A4 which in turn feed opposing coils S1A and S1B of the bidirectional solenoid 23.

In operation, the web 10 and the sensor 22 are adjusted so that the edge of the web 10 extends between light source 31 and photocell 32 to block or shade about one-half of the light beam therebetween, corresponding to the afore-mentioned "dead" band, to provide the centered position of the web or ribbon 10. The leading edge of the ribbon 10 is attached to core 18 on motor-driven spindles 19 which are activated to draw the ribbon through the apparatus at a speed of about 80 feet per minute to obtain edge alignment. This may be done independently of and prior to any other operation if desired whereby the ribbon may be aligned onto core 18 and then core 18 and original core 11 may be interchanged so that the passage of the aligned ribbon from core 18 through the inking operation causes the re-inked ribbon to be collected on its original core 11. This procedure is required for ribbons such as chain-printer ribbons which have an ink-free leader or other attachment at the start of the ribbon.

During passage of the continuous web 10 through the sensor 22, no activation of the solenoid 23 occurs if the web is already in edge alignment. However if the web is out of alignment the edge of the web will modify the illumination of photocell 32. This will produce a positive output by either comparator A1 (increase) or A2 (decrease) which will be amplified by A3 or A4 respectively and fed to coil S1A or S1B respectively.

Energizing of coil S1A by A1 and A3 causes the piston 24 of solenoid 23 to move outwardly from the solenoid to push the supporting carriage 14 laterally towards the side of the apparatus supporting the sensor 22 whereby the web 10 is moved inwardly so that the edge thereof blocks or shades more of the photocell beam to return the web to centered position within the "dead" band of the sensor 22, deenergizing coil S1A.

Energizing of coil S1B by A2 and A4 causes the piston 24 of solenoid 23 to retract into the solenoid and to pull the supporting carriage 14 laterally away from the side of the apparatus supporting the sensor 22 whereby the web 10 is moved outwardly so that the edge thereof uncovers more of the photocell beam to return the web to centered position within the "dead" band of the sensor 22, deenergizing coil S1B.

The electrical circuit of FIG. 5 also illustrates the presence of cross-coupling networks C1-R3 and C2-R4 between the A1-S1A circuit and the A2-S1B circuit. Such a coupling has been found to be necessary as a means for preventing the carriage 14 from overshooting centered position as a result of its inertia during adjustment. Without the cross-coupling the carriage 14 will overshoot considerably due to its inertia and the carriage will be constantly undergoing oscillating lateral movements which jerk the web from side to side and can cause it to crease or wrinkle.

The cross-coupling networks provide a means for damping such unwanted oscillation without slowing the response of the system. In operation, when A2 and A4 turn off coil S1B is deenergized. C1 and R3 couple the negative-going trailing edge of the pulse from A2 to output amplifier A3 wherein it is inverted, amplified and applied to opposing coil S1A as energy to stop the movement of the piston 24 and the carriage 14.

In like manner the turn-off of A1-A3 and deenergizing of coil S1A after correction simultaneously causes opposing coil S1B to receive a pulse coupled to A4 by C2-R4 and provide a braking action for the piston 24 and carriage 14. This bidirectional braking action permits the web 10 to be brought into perfect edge alignment with a minimum amount of movement of carriage 14 and without slowing the response of the carriage 14 to signals received from the sensor 22.

The present apparatus and method also includes means for automatically stopping movement of the web 10 in the event of breakage of the web or at any predetermined desired point, generally a short distance from the end of the web, to prevent the web from losing engagement with the supply core and losing tautness. As shown by FIG. 1 a means for causing the web to stop at a predetermined desired point comprises an activator bar 36 which is a lightweight metal bar which is attached to the ribbon at the predetermined desired location and is sufficiently long to have an extension 37 beyond the edge of the web 10 which passes the photoelectric sensor 22. Preferably the bar 36 is attached to the ribbon at the desired location during the initial alignment and inspection of the ribbon. Thus when the ribbon is passed during the inking cycle the extension 37 will be in position to stop the apparatus prior to the separation of the ribbon from its core.

The activator bar extension 37 functions by interposing a complete and abrupt interference with the light passing between light source 31 and photocell 32. The photocell 32 is connected to the power supply for the apparatus whereby an abrupt and complete interference with the photoelectric light beam disconnects the power supply and stops the apparatus.

Similarly, if the web tears and breaks during transport through the apparatus, as can happen in the case of paper webs and other webs of relatively weak fabric, the light beam between the light source 31 and photocell 32 will become abruptly and completely unobstructed. This sends an abrupt increased signal to the power supply which disconnects the power to the apparatus and stops the movement of the web.

If desired, the speed of the web through the alignment apparatus may be maintained relatively constant by the use of a variable speed motor to drive the take-up roll, associated with a tachometric idler roll in advance of the take-up roll. As the web speed tends to increase, due to the increasing diameter of the ribbon taken up on the core 18, the idler roll contacting the web rotates at a higher speed and such increase is sensed by a tachometer associated with the idler roll. The tachometer is associated with a generator or variable power source for the motor, so that the motor speed is reduced in inverse proportion to an increase in the number of rotations per minute (RPM) of the idler roll. In this manner the speed of the web is maintained relatively constant.

As disclosed supra, the present alignment apparatus is suitable for use with continuous fabric webs of all types, the only requirement being that the fabric, or at least the edge thereof being sensed, is sufficiently opaque or light-refractive to block the passage of light from the light source to the photocell of the sensor. In the case of translucent plastic film such film may have the edge thereof provided with a thin band or line of opaque ink.

Variations and modifications may be made within the scope of the claims and portions of the improvements may be made without others.

We claim:

1. An apparatus for checking and correcting the alignment of a continuous web or fabric material adapted to be supported in and moved through said apparatus, comprising a frame, a smooth shaft attached to said frame, a laterally-movable carriage slidably attached to said shaft and adapted to support said web, photoelectric sensing means mounted on said frame comprising a photoelectric light source and a photocell spaced therefrom and adapted to receive a continuous light beam from said light source and to sense variations in the level of illumination received from said light source during operation of said apparatus, said sensing means being so positioned that one edge of a continuous moving web passing therethrough is adapted to block a predetermined partial portion of the light beam between said light source and said photocell when said moving web is in centered position, means for moving said web through said sensing means so that one edge thereof normally blocks a predetermined partial portion of said light beam, a bi-directional solenoid associated with said frame and with said laterally-movable carriage and adapted to slide said carriage laterally on said smooth shaft in either direction relative to said frame, and means associated with said sensing means and with said solenoid for activating said solenoid to slide said carriage in a direction away from said sensing means when the edge of the web blocks more than said predetermined partial portion of said light beam and to slide said carriage in a direction towards said sensing means when the edge of the web blocks less than said predetermined partial portion of said light beam.

2. An apparatus according to claim 1 in which said laterally-movable carriage is adapted to support a continuous roll of said fabric material.

3. An apparatus according to claim 2 in which said carriage comprises a pair of spindles adapted to receive and hold a web-supporting core.

4. An apparatus according to claim 3 in which said spindles comprise a tension brake adapted to maintain a web being drawn from said core under tension.

5. An apparatus according to claim 1 which further comprises means connecting said photoelectric sensing means and the means for moving said web whereby abrupt and substantial variations in the amount of light received by said photocell from said light source cause deactivation of said web moving means.

6. An apparatus according to claim 1 in which said means for activating said solenoid comprises a pair of operational amplifiers one of which is connected to the solenoid to cause movement of the web support in one direction and the other of which is connected to the solenoid to cause movement of the web support in the opposite direction.

7. An apparatus according to claim 6 which further comprises cross-coupling means between said operational amplifiers and said solenoid whereby the deactivation of either one of said amplifiers causes a momentary activation of the other of said amplifiers to provide a braking action on the movement of said web support.

8. An apparatus according to claim 1 which comprises means for adjusting the value of said predetermined partial portion of said light beam whereby minor variations in the level of illumination on said photocell are insufficient to cause activation of said solenoid.

* * * * *